US007090149B2

(12) United States Patent
Fedorov

(10) Patent No.: US 7,090,149 B2
(45) Date of Patent: Aug. 15, 2006

(54) AIRBRUSH AND METHOD OF MAKING AN AIRBRUSH

(75) Inventor: Gennadi Fedorov, Andover, NJ (US)

(73) Assignee: Rose Art Industries, Inc., Livingston, NJ (US)

( * ) Notice: Subject to any disclaimer, the term of this patent is extended or adjusted under 35 U.S.C. 154(b) by 45 days.

(21) Appl. No.: 10/861,181

(22) Filed: Jun. 4, 2004

(65) Prior Publication Data

US 2005/0269423 A1 Dec. 8, 2005

(51) Int. Cl.
*B05B 7/30* (2006.01)

(52) U.S. Cl. ..... 239/346; 239/274; 239/302; 239/270; 239/418; 239/311; 239/318; 239/373

(58) Field of Classification Search ..... 239/274, 239/302, 327, 418, 270, 306, 311, 318, 338, 239/366, 373

See application file for complete search history.

(56) References Cited

U.S. PATENT DOCUMENTS

| | | | | |
|---|---|---|---|---|
| 165,773 | A | 7/1875 | Wheeler | |
| 563,195 | A | 6/1896 | Lyon | |
| 947,726 | A | 1/1910 | Zimmer | |
| 1,125,875 | A * | 1/1915 | Paasche | 239/415 |
| 1,272,752 | A | 7/1918 | Wold | |
| 1,517,926 | A | 12/1924 | Weekesser | |
| 1,806,784 | A | 5/1931 | Breuer | |
| 1,936,275 | A | 11/1933 | Siebert | |
| 1,948,533 | A | 2/1934 | Neely | |
| 2,354,063 | A | 7/1944 | Rose | |
| 3,521,643 | A | 7/1970 | Toth | |
| 3,829,023 | A * | 8/1974 | Bouillard et al. | 239/318 |
| D235,999 | S | 7/1975 | Harrell et al. | |
| 4,079,893 | A * | 3/1978 | Bass | 239/346 |
| 4,171,097 | A | 10/1979 | Rebold | |
| 4,193,550 | A * | 3/1980 | Juttelstad et al. | 239/314 |

(Continued)

FOREIGN PATENT DOCUMENTS

| | | |
|---|---|---|
| DE | 9402500 | 2/1997 |

(Continued)

OTHER PUBLICATIONS

Translation of the Jul. 12, 2000 decision of the District Court of The Hague in the matter P&M/Belaysia.

*Primary Examiner*—David A. Scherbel
*Assistant Examiner*—James S. Hogan
(74) *Attorney, Agent, or Firm*—Kenyon & Kenyon LLP

(57) ABSTRACT

An apparatus is provided for spraying an atomized liquid, which includes a hollow casing including an inlet and an outlet. The inlet is adapted to receive an airflow. The outlet includes a nozzle having an aperture. The apparatus also includes a liquid cartridge associated with the hollow casing and a tube with a tip and a source end attached to the liquid cartridge. The tip of the tube is positioned in a region on a side of the nozzle outside of an interior of the hollow casing and the tube is adapted to draw a liquid out of the liquid cartridge. A method is provided for producing an airbrush, which includes providing two halves of an outlet end of a hollow casing and providing an inlet end of the hollow casing. The method further includes providing a liquid cartridge including anchors for attaching the liquid cartridge to the two halves of the outlet end and providing a nozzle insert adapted to fit between the two halves of the outlet end near an outlet. The method further includes welding the two halves together to form an outlet component, thereby sandwiching between the two halves the liquid cartridge and the nozzle insert.

20 Claims, 4 Drawing Sheets

U.S. PATENT DOCUMENTS

| | | | |
|---|---|---|---|
| D261,547 | S | 10/1981 | Parke |
| 4,634,053 | A | 1/1987 | Herzfeld et al. |
| 4,685,622 | A | 8/1987 | Shimohira et al. |
| 4,758,849 | A | 7/1988 | Piatt et al. |
| 4,978,072 | A | 12/1990 | Kurowski |
| 5,156,684 | A | 10/1992 | Mayer et al. |
| 5,190,220 | A | 3/1993 | Bolton |
| 5,248,096 | A | 9/1993 | Hoey et al. |
| 5,322,220 | A | 6/1994 | Rehkemper |
| 5,366,158 | A | 11/1994 | Robisch et al. |
| 5,421,518 | A | 6/1995 | Robisch et al. |
| 5,454,517 | A | 10/1995 | Naemura |
| 5,687,886 | A | 11/1997 | Bolton |
| 5,842,646 | A | 12/1998 | Kitajima |
| 6,024,300 | A * | 2/2000 | Bolton ..... 239/326 |
| 6,270,021 | B1 | 8/2001 | Bolton |
| 6,283,388 | B1 | 9/2001 | Bolton |

FOREIGN PATENT DOCUMENTS

| | | |
|---|---|---|
| GB | 237278 | 1/1926 |
| GB | 2177620 | 1/1987 |
| GB | 2245196 | 1/1992 |
| GB | 2257058 | 1/1993 |
| GB | 2273065 | 6/1994 |
| JP | 61-42352 | 2/1986 |
| JP | 61-42650 | 2/1986 |
| WO | WO 94/12288 | 6/1994 |

* cited by examiner

AIRBRUSH AND METHOD OF MAKING AN AIRBRUSH

FIELD OF THE INVENTION

The present invention relates to writing and drawing instruments. More particularly, the present invention relates to an airbrush and a method for producing an airbrush.

BACKGROUND INFORMATION

U.S. Pat. No. 5,687,886 discusses an apparatus for dispensing a fine spray of liquid particles. The apparatus apparently comprises a hollow tubular housing and a reservoir pen formed with a nib of absorbent material which is retained within and spaced from the inner wall of the housing. The tubular housing includes at one end a nozzle whose interior defines a converging path and at its other end a mouthpiece through which air can be caused to flow through the tubular housing and over the pen to the outlet orifice of the nozzle. An abutment is provided within the housing for locating the pen within the housing with its absorbent nib at least partially within the boundary of the outlet orifice of the nozzle.

U.S. Pat. No. 6,024,300 discusses an apparatus for dispensing a fine spray of liquid particles that apparently comprises a hollow tubular casing whose internal cross section is formed with at least one abutment surface. A tubular liquid source is positioned within the casing with the abutment surface in close contact with the outer surface of the source to provide support thereto. The casing includes a passageway for the flow of air from a mouthpiece positioned at one end of the casing to a nozzle positioned at the other end of the casing into which the discharge end of the liquid source protrudes.

The prior art references include felt tip pens and nibs of absorbent material. The references apparently disclose that the liquid is dispersed from the absorbent material into the flow of air. Additionally, the references apparently disclose the nib of material being within the boundary of the outlet nozzle.

Airbrushes utilizing nibs of material may have the disadvantage that the nib dries easily and may be difficult to operate. Also, nibs may be used in conjunction with a filter which holds the ink in a barrel. The combination of the filter and barrel may limit the amount of ink which may be accessed by the nib.

There is thus a need for an efficient method of drawing liquid and dispersing the liquid into an air stream, and for accessing more liquid ink with an airbrush.

SUMMARY

An apparatus is provided for spraying an atomized liquid, which includes a hollow casing including an inlet and an outlet. The inlet is adapted to receive an airflow. The outlet includes a nozzle having an aperture. The apparatus also includes a liquid cartridge associated with the hollow casing and a tube having a tip and a source end. The source end of the tube is attached to the liquid cartridge. The tip of the tube is positioned in a region on a side of the nozzle outside of an interior of the hollow casing and the tube is adapted to draw liquid out of the liquid cartridge.

The airflow received into the inlet may pass through the hollow casing, may pass out of the nozzle, may creat a low pressure in the region, may draw the liquid out of the tip of the tube, and may atomize the liquid. The drawing of the liquid out of the tip of the tube by the low pressure region may be caused by a venturi effect.

The apparatus may further include an arrangement for attaching the liquid cartridge to the hollow casing, which may include welding two halves of the casing into a single unit. The two halves may sandwich a plurality of anchors of the cartridge. The anchors may extend into the interior of the hollow casing. The cartridge may be arranged flush to the exterior of the hollow casing. The welding may include an ultrasonic welding of the two halves of the hollow casing to each other and possibly to the anchors.

The hollow casing and/or the liquid cartridge may include plastic. The tip may be arranged perpendicular to the flow of air in the region. The liquid cartridge may include an air inlet arranged on the liquid cartridge opposite of the tube. An opening on the tip of the tube may have a diameter sufficiently small to prevent a flow of the liquid out of the tip due to surface tension absent a flow of low pressure air over the tip. The aperture of the nozzle may be one of equal to and slightly larger than the tip of the tube. The tip may include a short tube with a constricted throat. The inlet may be adapted to receive the airflow directly from a human mouth. The inlet may be adapted to receive the airflow from a flexible tube.

A method is provided for producing an airbrush, which includes providing two halves of an outlet end of a hollow casing and providing an inlet end of the hollow casing. The method further includes providing a liquid cartridge including anchors for attaching the liquid cartridge to the two halves of the outlet end and possibly providing a nozzle insert adapted to fit between the two halves of the outlet end near an outlet. The method further includes welding the two halves together to form an outlet component, thereby sandwiching between the two halves the liquid cartridge and possibly the nozzle insert.

The method may further include joining the outlet component and the inlet end, possibly by a friction fit. The two halves of the outlet end may include plastic. The joining of the two halves of the outlet end may include ultrasonic welding.

DETAILED DESCRIPTION

The functional principle of the present invention is based on the Venturi effect of spraying. Air escaping from end of one tube at a certain minimal speed and pressure creates a zone of low pressure. Another tube positioned below the zone of low pressure is connected to a reservoir of a liquid. The zone of low pressure forces liquid to move into the air flow where particles of liquid are broken down and dispersed as a mist. The quality of the spraying effect and the amount of minimum air pressure may depend on several factors, including: the diameter of the tubes; the positioning of the tube ends against, or adjacent to, each other; the angle of the tube ends with respect to each other; and the viscosity of the sprayed liquid. As a general rule, the tubes must be either of equal diameter or the air tube may be slightly larger than the ink tube.

An airbrush according to an exemplary embodiment of the present invention may be a simple, effective, plastic spraying tool for children and/or adults to spray washable inks in their artwork. The airbrush may be designed as a single use tool or a refillable/reusable tool. As a single use tool, the airbrush may be used as long as there is a supply of ink in the ink tank. After all the ink in the tank has been used, the whole tool may discarded. A modification to the design may allow the ink reservoir to be replaceable using ink replacement kits.

Figure 1:
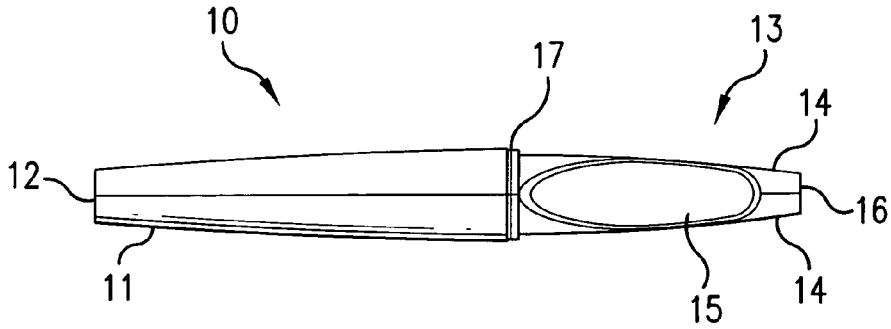
FIG. 1 is a bottom view of an exemplary embodiment of the present invention.

FIG. 1 is a bottom view of an exemplary embodiment of the present invention showing airbrush 10. Airbrush 10 includes inlet housing 11 and outlet assembly 13. Inlet housing 11 includes an inlet 12 that is adapted to be blown into by a human mouth. Outlet assembly 13 includes two outlet assembly halves 14, liquid cartridge 15, and outlet 16. Liquid cartridge 15 may be adapted to carry any type of liquid, including inks that may or may not be water soluble. Inlet housing 11 may attach to outlet assembly 13 by a friction fit that may be limited from further movement by stopper 17. When air is blown in inlet 12 of airbrush 10, the air flows along the length of inlet housing 11 and outlet assembly 13 and out outlet 16.

Figure 2:
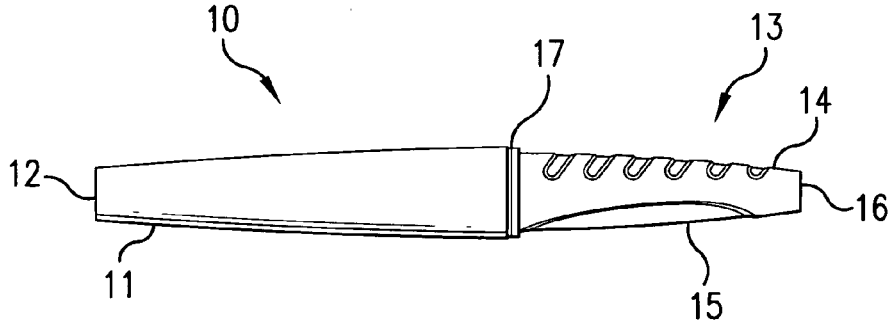
FIG. 2 is a side view of an exemplary embodiment of the present invention.

FIG. 2 is a side view of an exemplary embodiment of the present invention showing airbrush 10 including inlet housing 11 and outlet assembly 13. Liquid cartridge 15 of outlet assembly 13 is shown in profile in FIG. 2.

Figure 3:
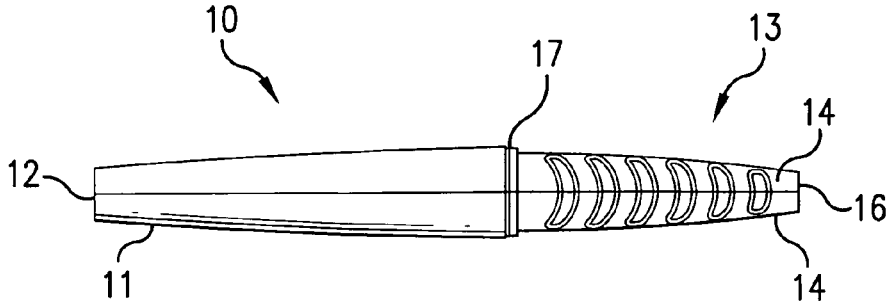
FIG. 3 is a plan view of an exemplary embodiment of the present invention.

FIG. 3 is a plan view of an exemplary embodiment of the present invention showing airbrush 10 including inlet housing 11 and outlet assembly 13. Inlet housing 11 has an inlet 12 and outlet assembly 13 includes two outlet assembly halves 14, stopper 17, and outlet 16.

Figure 4:
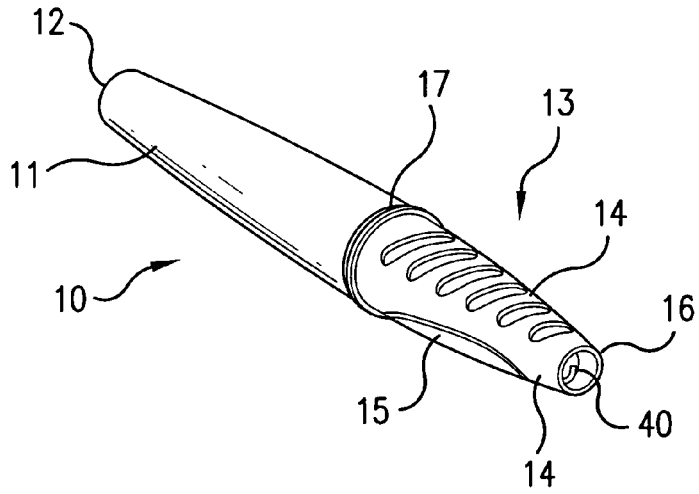
FIGS. 4 and 5 are axonometric views of an exemplary embodiment of the present invention.
Figure 5:
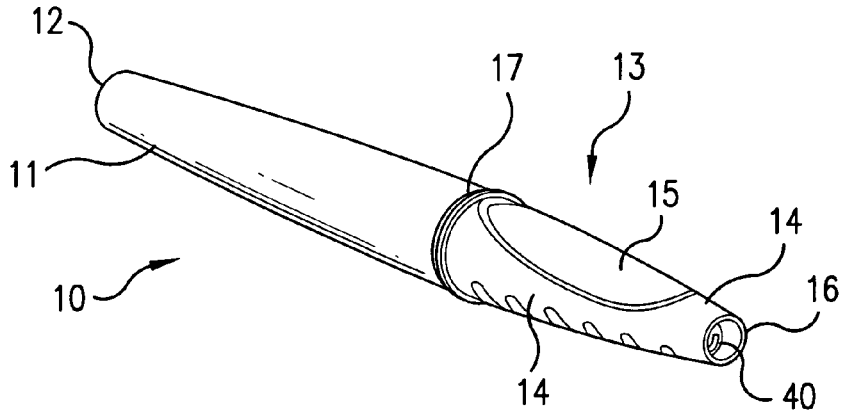

FIGS. 4 and 5 are axonometric views of an exemplary embodiment of the present invention of airbrush 10. FIG. 4 also shows ink tank tube 40 that is arranged near outlet 16 of outlet assembly 13. The exact position of ink tank tube 40 is described in the following description.

FIG. 5 illustrates the exemplary embodiment of FIG. 4 including ink tank tube 40, liquid cartridge 15, outlet assembly 13, and inlet housing 11.

Figure 6:
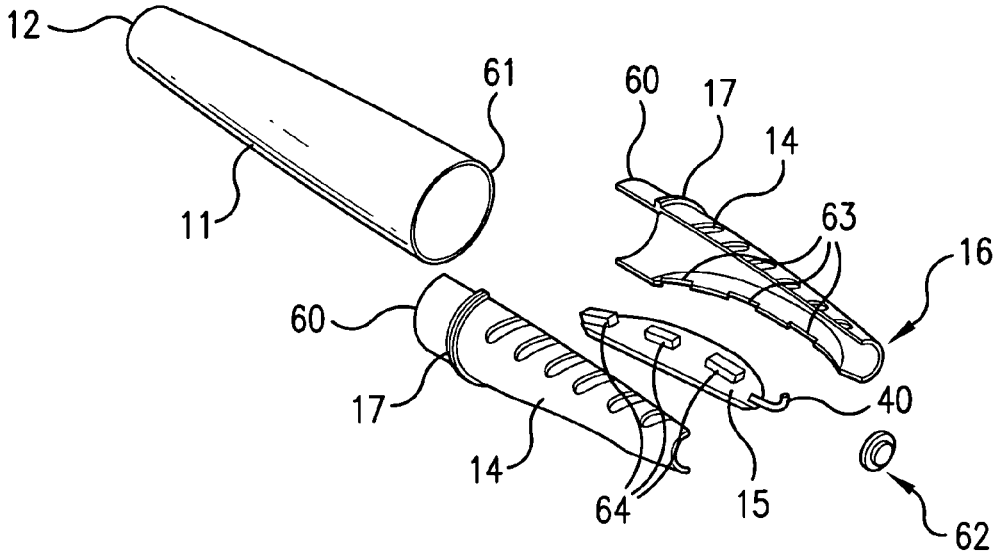
FIG. 6 is an exploded view of an exemplary embodiment of the present invention.

FIG. 6 is an exploded view of an exemplary embodiment of the present invention of airbrush 10 showing the elements of airbrush 10 in an unassembled condition. FIG. 6 shows inlet friction fit 61 as well as inlet 12 of inlet housing 11. Inlet friction fit 61 is adapted to slide over outlet friction fit 60 of outlet assembly halves 14 up to stopper 17. Alternatively, outlet friction fit 60 may be adapted to slide over inlet friction fit 61. Between two outlet assembly halves 14 is shown liquid cartridge 15. Liquid cartridge 15 includes an ink tank tube 40 at one end. Liquid cartridge 15 also includes anchors 64. Anchors 64 are adapted to fit in anchor slots 63 on outlet assembly halves 14 when outlet assembly halves 14 are welded together, thereby securing liquid cartridge 15 to the exterior of two outlet assembly halves 14. Also shown in FIG. 6 is nozzle 62. Nozzle 62 is adapted to fit securely between two outlet assembly halves 14 when outlet assembly halves 14 are welded together. Nozzle 62 is secured near outlet 16 when outlet assembly halves 14 are welded together. Nozzle 62 has an aperture to channel the flow of air out of airbrush 10.

An exemplary embodiment of the present invention may include two major components: a back-end air tube (also referred to herein as inlet housing 11) and a front-end assembly (also referred to herein as outlet assembly 13). The back-end tube may be a single plastic piece. The front-end assembly may include two housing halves (also referred to herein as outlet assembly halves 14) that may be assembled together in an ultrasonic plastic welding process to ensure an airtight fit around the seam line. An ink tank (also referred to herein as liquid cartridge 15) may have two or three anchoring details (also referred to herein as anchors 64) that are adapted to lock the ink tank onto the housing assembly between the two halves, possibly making it a permanent assembly. There may also be an air nozzle insert (also referred to herein as nozzle 62), which is a small part with a hole in the middle that is positioned at the outlet nozzle between the two halves during ultrasonic assembly. Air may be blown through the length of the tool and may escape through the short tubular extension of the air nozzle insert. After passing through the air nozzle insert, air may flow above the end of an ink tube (also referred to herein as ink tank tube 40) that extends from the ink tank to the nozzle area.

The back-end air tube may be a simple, thin-wall tubular piece injected in polypropylene plastic. The user may put the rear section in his/her mouth and blow through it. Two halves of the front-end housing may be thin-wall plastic components that may be injected in either polyprolylene or polystyrene. The back-end air tube and/or the two halves of the front-end housing may be assembled onto each other with ultrasonic welding to provide an airtight seal on the joint line. During assembly, the sections may lock an ink tank using anchoring elements (also referred to herein as anchors 64) in between the two halves of the front-end housing and may also lock the nozzle insert between the two halves of the front end housing.

Figure 7:
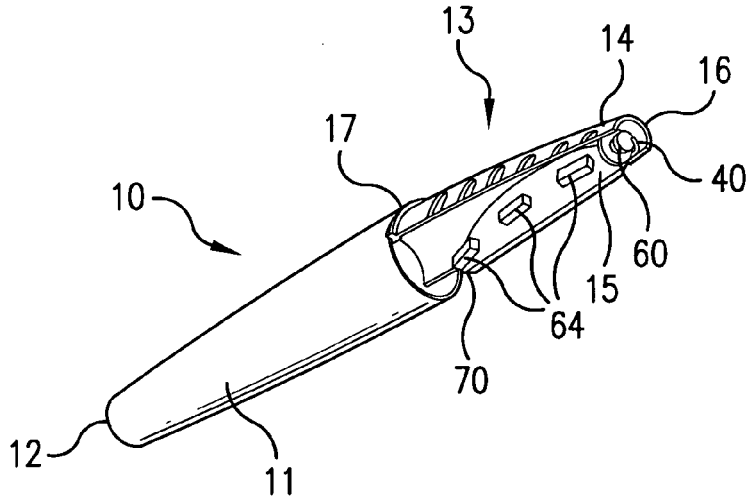
FIG. 7 is a sectional view of an exemplary embodiment of the present invention.

FIG. 7 is a sectional view of an exemplary embodiment of the present invention of airbrush 10 showing the elements of airbrush 10 in an assembled state with one outlet assembly half 14 missing. Visible in FIG. 7 is inlet 12 of inlet housing 11 and stopper 17. Liquid cartridge 15 is shown in FIG. 7 adjacent to one outlet assembly half 14 and includes ink tank tube 40 at one end. Liquid cartridge 15 also includes anchors 64 which are secured, in FIG. 7, in anchor slots on one outlet assembly half 14. Also shown in FIG. 7 is nozzle 62 adjacent to one outlet assembly half 14. Nozzle 62 is secured near outlet 16 when another assembly half 14 is welded to outlet assembly half 14. Nozzle 62 has an aperture to channel the flow of air out of airbrush 10. Ink tank tube 40 may be situated just outside of nozzle 62 with the tip of ink tank tube in or adjacent to a flow of air passing out of nozzle 62 from the interior of airbrush 10. Ink tank tube 40 may be situated within the outer edge of outlet 16.

Liquid cartridge 15 may have a small diameter venting tube 70 of metal, plastic, or any other appropriate material. Venting tube 70 may enter the ink reservoir at an end opposite to ink tank tube 40. Venting tube 70 may provide air venting, which may be necessary to replace the volume of used ink inside liquid cartridge 15 with the same volume of air and to equalize atmospheric pressure inside and outside liquid cartridge 15. Venting tube 70 may be of a very small diameter to provide air passage and to ensure by liquid surface tension that ink does not flow freely out of liquid cartridge 15.

The principle of an airbrush according to an exemplary embodiment of the present invention is based on the Venturi effect of spraying. A possible advantage of this design is its simplicity and, thus, its low production and retail cost. A user may provide the necessary airflow and pressure by blowing by the mouth into a rear section of the pen. Alternatively, a flexible tube may be adapted to secure to the end of the airbrush. Pressurized air may be supplied to the flexible tube by either a human mouth, a hand-powered pump, an electric pump, or by any other appropriate method of supplying pressurized air. Air may then flow through the mouthpiece and through the mostly empty cavity of a front-end assembly. Then the air may pass through a small hole of the nozzle insert and escape directly above an end of a thin ink tube, thereby creating a lower pressure area there. The low pressure area above the end of the thin ink tube may draw ink out of the ink tube and disperse it into the airflow.

Figure 8:
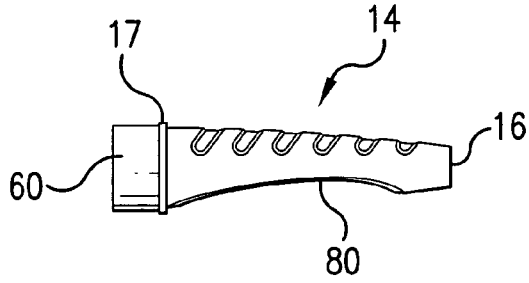
FIGS. 8, 9 and 10 are various side views of a section of an exemplary embodiment of the present invention.

FIG. 8 illustrates a side view from the outside of outlet assembly half 14 of an exemplary embodiment of the present invention. FIG. 8 shows outlet friction fit 60, stopper 17, and outlet 16. The side view of FIG. 8 illustrates cartridge recess 80 on outlet assembly half 14. Cartridge recess 80 is adapted to accept a liquid cartridge in anchor slots, enabling the liquid cartridge to be secured flush to the exterior of outlet assembly half 14.

Figure 9:
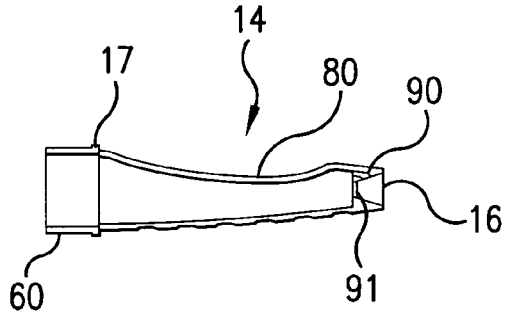

FIG. 9 illustrates a side view from the inside of outlet assembly half 14 of an exemplary embodiment of the present invention. FIG. 9 shows outlet friction fit 60, stopper 17, and outlet 16. The side view of FIG. 9 illustrates cartridge recess 80 on outlet assembly half 14. FIG. 9 also shows tube recess 90, which is adapted to accept an ink tank tube extending from a liquid cartridge accepted in cartridge recess 80. Tube recess 90 allows an ink tank tube to extend into outlet 16. Outlet 16 is shown in FIG. 9 as an expanding region extending from constriction point 91 to the edge of outlet 16. Constriction point 91 is adapted to engage, on an inward side of constriction point 91, a nozzle.

Figure 10:
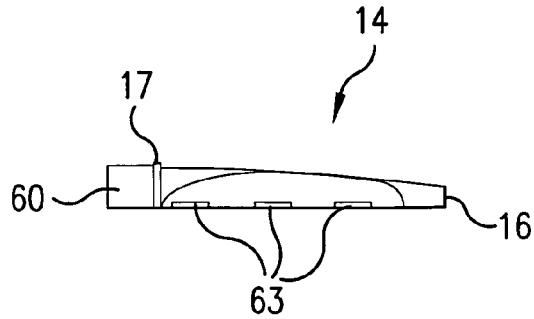

FIG. 10 illustrates a bottom view of outlet assembly half 14 of an exemplary embodiment of the present invention. FIG. 10 shows outlet friction fit 60, stopper 17, and outlet 16. Three anchor slots 63 are shown in FIG. 10, though more or fewer anchor slots 63 are possible.

While the present invention has been described in connection with the foregoing representative embodiment, it should be readily apparent to those of ordinary skill in the art that the representative embodiment is exemplary in nature and is not to be construed as limiting the scope of protection for the invention as set forth in the appended claims.

What is claimed is:

1. An apparatus for spraying an atomized liquid, comprising:

a substantially cylindrical, hollow casing comprising an inlet and an outlet, the inlet being adapted to receive an airflow, the outlet comprising a nozzle having an aperture;

a liquid cartridge associated with the hollow casing and arranged within a rotational protection of the casing; and a tube with a tip and a source end communicating with the liquid cartridge, the tip of the tube positioned in a region on a side of the nozzle outside of an interior of the hollow casing, the tube adapted to draw a liquid out of the liquid cartridge.

2. The apparatus of claim 1, wherein the airflow received into the inlet passes through the hollow casing, passes out of the nozzle, creates a low pressure in the region, draws the liquid out of the tip of the tube, and atomizes the liquid.

3. The apparatus of claim 2, wherein the drawing of the liquid out of the tip of the liquid cartridge by the low pressure region is caused by a venturi effect.

4. The apparatus of claim 1, further comprising an arrangement for attaching the liquid cartridge to the hollow casing.

5. The apparatus of claim 1, wherein at least one of the hollow casing and the liquid cartridge comprises plastic.

6. The apparatus of claim 1, wherein the aperture of the nozzle is one of equal to and slightly larger than the tip of the tube.

7. The apparatus of claim 1, wherein the tip comprises a short tube with a constricted throat.

8. The apparatus of claim 1, wherein the inlet is adapted to receive the airflow directly from a human mouth.

9. The apparatus of claim 1, wherein the inlet is adapted to receive the airflow from a flexible tube.

10. An apparatus for spraying an atomized liquid, comprising:

a hollow casing comprising an inlet and an outlet, the inlet being adapted to receive an airflow, the outlet comprising a nozzle having an aperture;

a liquid cartridge associated with the hollow casing;

a tube with a tip and a source end communicating with the liquid cartridge, the tip of the tube positioned in a region on a side of the nozzle outside of an interior of the hollow casing, the tube adapted to draw a liquid out of the liquid cartridge; and an arrangement for attaching the liquid cartridge to the hollow casing;

wherein the arrangement for attaching the liquid cartridge to the hollow casing comprises a welding of two halves of the casing into a single unit, the two halves sandwiching a plurality of anchors of the cartridge, the anchors extending into the interior of the hollow casing, the cartridge being arranged flush to an exterior of the hollow casing.

11. The apparatus of claim 10 wherein the welding comprises an ultrasonic welding of the two halves of the hollow casing to each other.

12. An apparatus for spraying an atomized liquid, comprising:

a hollow casing comprising an inlet and an outlet, the inlet being adapted to receive an airflow, the outlet comprising a nozzle having an aperture;

a liquid cartridge associated with the hollow casing; and a tube with a tip and a source end communicating with the liquid cartridge, the tip of the tube positioned in a region on a side of the nozzle outside of an interior of the hollow casing, the tube adapted to draw a liquid out of the liquid cartridge;

wherein the tip is arranged perpendicular to the flow of air in the region.

13. An apparatus for spraying an atomized liquid, comprising:

a hollow casing comprising an inlet and an outlet, the inlet being adapted to receive an airflow, the outlet comprising a nozzle having an aperture;

a liquid cartridge associated with the hollow casing; and a tube with a tip and a source end communicating with the liquid cartridge, the tip of the tube positioned in a region on a side of the nozzle outside of an interior of the hollow casing, the tube adapted to draw a liquid out of the liquid cartridge;

wherein the liquid cartridge comprises an air inlet arranged on the liquid cartridge opposite the source end of the tube.

14. An apparatus for spraying an atomized liquid, comprising:

a hollow casing comprising an inlet and an outlet, the inlet being adapted to receive an airflow, the outlet comprising a nozzle having an aperture;

a liquid cartridge associated with the hollow casing; and a tube with a tip and a source end communicating with the liquid cartridge, the tip of the tube positioned in a region on a side of the nozzle outside of an interior of the hollow casing, the tube adapted to draw a liquid out of the liquid cartridge;

wherein an opening on the tip of the tube comprises a diameter sufficiently small to prevent a flow of the liquid out of the tip due to surface tension absent a flow of low pressure air over the tip.

15. A method for producing an airbrush, comprising:

providing two halves of an outlet end of a hollow casing;

providing an inlet end of the hollow casing;

providing a liquid cartridge including anchors for attaching the liquid cartridge to the two halves of the outlet end; and welding the two halves together to form an outlet component, thereby sandwiching between the two halves the liquid cartridge and the nozzle insert.

16. The method according to claim 15, further comprising providing a nozzle insert adapted to fit between the two halves of the outlet end near an outlet.

17. The method according to claim 15, further comprising joining the outlet component and the inlet end.

18. The method according to claim 17, wherein the joining of the outlet component and the inlet end comprises a friction fit.

19. The method according to claim 15, wherein the two halves of the outlet end comprise plastic.

20. The method according to claim 19, wherein the welding of the two halves of the outlet end comprises ultrasonic welding.

* * * * *